US009637254B2

(12) United States Patent
Fahldieck et al.

(10) Patent No.: US 9,637,254 B2
(45) Date of Patent: May 2, 2017

(54) METHOD, FILLING SYSTEM AND FILLING ELEMENT FOR FILLING CONTAINERS

(75) Inventors: Andreas Fahldieck, Idar-Oberstein (DE); Jonathan Lorenz, Bad Kreuznach (DE); Dieter-Rudolf Krulitsch, Bad Kreuznach (DE); Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 275 days.

(21) Appl. No.: 14/344,618

(22) PCT Filed: Aug. 2, 2012

(86) PCT No.: PCT/EP2012/003281

§ 371 (c)(1),
(2), (4) Date: Mar. 13, 2014

(87) PCT Pub. No.: WO2013/037441

PCT Pub. Date: Mar. 21, 2013

(65) Prior Publication Data

US 2014/0345745 A1 Nov. 27, 2014

(30) Foreign Application Priority Data

Sep. 13, 2011 (DE) ..... 10 2011 112 925

(51) Int. Cl.

| | |
|---|---|
| ***B65B 3/26*** | (2006.01) |
| ***B65B 3/04*** | (2006.01) |
| ***B67C 3/20*** | (2006.01) |
| ***B67C 3/26*** | (2006.01) |
| ***B67C 3/28*** | (2006.01) |
| ***B67C 3/00*** | (2006.01) |

(52) U.S. Cl.

CPC ..... *B65B 3/26* (2013.01); *B65B 3/04* (2013.01); *B67C 3/002* (2013.01); *B67C 3/20* (2013.01); *B67C 3/26* (2013.01); *B67C 3/28* (2013.01); *B67C 3/286* (2013.01)

(58) Field of Classification Search

CPC .. G01F 1/586; B65B 3/04; B65B 3/26; B67C 3/26; B67C 3/20

USPC ..... 141/82, 9, 90, 91, 105, 302, 94, 89, 2; 222/148

See application file for complete search history.

(56) References Cited

U.S. PATENT DOCUMENTS

| | | | | |
|---|---|---|---|---|
| 3,100,504 | A * | 8/1963 | Kauer, Jr. | F16K 17/10 137/494 |
| 3,193,395 | A * | 7/1965 | Tabler | C12G 3/105 426/329 |
| 3,690,172 | A * | 9/1972 | Ketelsen | G01F 1/586 73/861.12 |

(Continued)

FOREIGN PATENT DOCUMENTS

| | | |
|---|---|---|
| CN | 101 348 226 | 1/2009 |
| DE | 19 11 601 | 3/1965 |

(Continued)

*Primary Examiner* — Mark A Laurenzi
*Assistant Examiner* — James Hakomaki
(74) *Attorney, Agent, or Firm* — Occhiuti & Rohlicek LLP

(57) ABSTRACT

A method for filling containers with filling goods that comprise liquid that has a solids content includes using a magnetically inductive flow meter for controlling at least one of volume and quantity of said filling goods in a particular container.

21 Claims, 5 Drawing Sheets

(56) References Cited

U.S. PATENT DOCUMENTS 3,924,466 A * 12/1975 Medlar ..... G01F 1/588 73/861.12
4,942,045 A * 7/1990 Thumm ..... C12G 3/08 426/11
5,377,726 A * 1/1995 Clusserath ..... B67C 3/286 141/261
5,750,902 A * 5/1998 Schwiderski ..... G01F 1/586 73/861.11
6,123,320 A * 9/2000 Rasanow ..... F16K 7/12 251/331
6,189,578 B1 * 2/2001 Clusserath ..... B67C 3/10 141/293
6,397,887 B1 * 6/2002 Crissman ..... F16K 7/126 137/240
6,467,505 B1 * 10/2002 Thordarson ..... G05D 7/0106 137/606
6,470,922 B2 * 10/2002 Sindermann ..... B67C 3/10 141/37
6,494,238 B2 * 12/2002 Sindermann ..... B67C 3/222 141/11
6,672,561 B2 * 1/2004 Kerg ..... F16K 41/103 251/331
6,887,505 B2 * 5/2005 Reaves ..... A23C 1/12 426/115
6,889,709 B2 * 5/2005 Hanada ..... F16K 27/003 137/606
6,951,228 B2 * 10/2005 Steigerwalt ..... A61J 3/002 137/606
6,957,781 B2 * 10/2005 Gowens ..... B05B 15/025 222/145.1
7,308,917 B2 * 12/2007 Krulitsch ..... B67C 3/26 141/198
7,328,112 B2 * 2/2008 Wandeler ..... G01F 1/60 702/100
7,353,848 B2 * 4/2008 Krulitsch ..... B67C 3/06 141/146
7,571,749 B2 * 8/2009 Stocchi ..... B67C 3/004 141/105
7,686,043 B2 * 3/2010 Berger ..... B65B 39/00 141/286
2001/0045242 A1 * 11/2001 Clusserath ..... B67C 3/286 141/144
2002/0014276 A1 * 2/2002 Clusserath ..... B67C 3/065 141/40
2003/0068251 A1 * 4/2003 Smith ..... A61L 2/208 422/28
2004/0149784 A1 * 8/2004 Solignac ..... B65B 39/004 222/504
2006/0037286 A1 * 2/2006 Bernhard ..... F16C 21/00 53/281
2007/0065561 A1 * 3/2007 Livaich ..... A23L 2/02 426/599
2009/0095370 A1 * 4/2009 Krulitsch ..... B67C 3/004 141/6
2009/0159612 A1 * 6/2009 Beavis ..... A47J 31/36 222/52
2009/0236007 A1 * 9/2009 Clusserath ..... B65B 3/26 141/9
2010/0059128 A1 * 3/2010 Reck ..... F16K 5/0605 137/597
2010/0108180 A1 * 5/2010 Clusserath ..... B67C 3/004 141/1
2010/0119667 A1 * 5/2010 Livaich ..... C12G 3/06 426/131
2010/0132834 A1 * 6/2010 Clusserath ..... B67C 3/045 141/115
2011/0005637 A1 * 1/2011 Meinzinger ..... B67C 3/02 141/104
2011/0039044 A1 * 2/2011 Clusserath ..... B67C 3/001 428/34.1
2011/0260091 A1 * 10/2011 Feldmeier ..... F16K 11/20 251/331

FOREIGN PATENT DOCUMENTS

DE 3540997 A1 * 5/1987 ..... F16K 31/404
DE 201 05 716 5/2002
DE 20105716 5/2002
DE 10 2006 014 103 9/2007
DE 10 2007 024 106 11/2008
DE 10 2008 016 296 10/2009
DE 102008016296 A1 * 10/2009 ..... G01F 13/006
JP 2005 145527 6/2005
JP 2006 168777 6/2006
JP 2010 189069 9/2010
WO WO2011/044972 4/2011

* cited by examiner

METHOD, FILLING SYSTEM AND FILLING ELEMENT FOR FILLING CONTAINERS

RELATED APPLICATIONS

This application is the national stage under 35 USC 371 of PCT application PCT/EP2012/003281, filed on Aug. 2, 2012, which claims the benefit of the Sep. 13, 2011 priority date of German application DE102011112925.5, the contents of which are herein incorporated by reference.

FIELD OF DISCLOSURE

The invention concerns filling containers with liquid foodstuffs.

BACKGROUND

In the beverage industry, it is known to use magnetically inductive flow meters to measure how much liquid enters a container.

Magnetically inductive flow meters work best when there is a continuous flow of electrically conductive liquid over a prolonged period, such as several minutes or hours. This is because the greatest measuring inaccuracies occur at the start and end of a filling process.

However, when filling containers in the beverages and/or food industry, there are generally no long filling periods. It takes on the order of seconds to fill a container. Thus, the flow is constantly being interrupted. This leads to measuring inaccuracies.

SUMMARY

The invention provides a method and a filling system for filling containers with filling goods containing solids, in the form of beverages or foodstuffs, without any problems and with a high level of operational reliability.

The invention is based on the realization that a magnetically inductive flow-meter can preform accurate volume-controlled or quantity-controlled filling of filling goods that have a high solids content, in the range of 30% by weight to 60% by weight, when the filling goods flow through the magnetically inductive flow-meter at a sufficiently high flow rate or with a sufficient high volume rate of flow. Suitable flow rates are flow rates of more than one meter per second. Suitable volume rates of flow are 500 ml within ten seconds, 50-150 ml within ten seconds, 500 ml within five seconds, or 500 ml within two seconds.

The invention provides a simple and easy-to-clean filling system in which one can avoid costly work associated with, for example, dismantling of elements of the filling system during cleaning. The invention also enables precise dosing of the filling goods and also of the solids contained in the filling goods. In addition, the invention enables problem-free switchover of the filling operation from the processing of filling goods with one solids content to the processing of filling goods with a different solids content.

Magnetically inductive flow-meter operation is based on electrically conductive filling goods flowing through a magnetic field and thereby inducing a measurable voltage that can be analyzed as a measured signal. This signal can be measured by, for example a voltage being tapped by electrodes. The voltage depends on the movement of the filling goods relative to the magnetic field.

To increase the measuring precision, especially when filling containers with filling goods that have a high solids content, it is furthermore proposed according to the invention, that filling goods flow through a rotary magnetic field. This creates an additional relative speed between the filling goods and the magnetic field. In particular, the rotary magnetic field is effective in the critical areas at the start of filling, i.e. immediately after the opening of the liquid valve of a filling element, and also at the end of the filling process, i.e. upon closing the liquid valve, thus in areas in which the flow speed of the filling goods is reduced and/or is, in addition, permanently altered. The magnetic rotary field significantly increases the measuring precision.

The purpose of the invention is furthermore to disclose a filling element for filling containers with liquid filling goods, in particular filling goods with a high solids content. This filling element is characterized by improved properties, in particular with regard to the flow conditions inside the filling element when filling containers and also in a hot cycle, when rinsing the filling element and/or during CIP cleaning and/or CIP disinfection.

The dimensions of the filling element, in particular of the valve chamber associated with the filling element, the cross-section of the intake or inlet, and the cross-section of the drain or outlet are selected to reliably avoid any dead spaces, such as undercuts. The entire valve chamber of the filling element thus constantly has either a through-flow of filling goods, during filling, or a through-flow of treatment medium, during rinsing, CIP cleaning, disinfection, or the heat maintenance. In this way, during heat maintenance, the entire filling element is held at the target temperature, and likewise, in the case of rinsing, CIP cleaning, and/or CIP disinfection, the treatment medium flows reliably over all the internal surfaces of the filling element to ensure a nearly perfect cleaning and/or disinfection of all the surfaces of the filling element.

In a preferred embodiment of the invention, an axial length of an outlet stretch that connects to a valve seat and/or that forms or that has the discharge opening is selected to be extremely short and to substantially match the wall thickness. This ensures strength, of the filling element in the area of the discharge opening.

Additionally, as a result of the foregoing features, during the CIP cleaning and/or CIP disinfection, a space between the valve seat and a CIP closure develops an intensive through-flow of treatment medium, this being in connection with the flow direction generated by the arrangement of the inlet and outlet in the valve chamber. Without additional connections to the CIP closure or within the area of the CIP closure, in the space between the valve seat and the CIP closure, there arises a particularly intensive mixing and flow of the treatment medium, and thus, an exceptionally intensive cleaning.

As used herein, "containers" includes cans, bottles, tubes, pouches, in each case made of metal, glass and/or plastic, and other packaging means that are suitable for filling with liquid or viscous products.

As used herein, "free jet filling" means a process in which liquid filling goods flow into a container to be filled in a free filling jet, and in which the container mouth or opening of the container does not lie against the filling element, but is, instead, at a distance from the filling element or from a filling goods outlet at the filling element. A substantial feature of free jet filling is that the air forced out of the container by the liquid filling goods during the filling process does not enter the filling element or an area or channel formed in the filling element. Instead, it flows freely out into the environment.

As used herein, the expression "substantially" or "approximately" means deviations from exact values by ±10%, and preferably by ±5%, and/or deviations in the form of changes not significant for functioning.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE FIGURES

The invention is explained in more detail below by means of the figures of examples of embodiments, in which.

DETAILED DESCRIPTION

Figure 1:
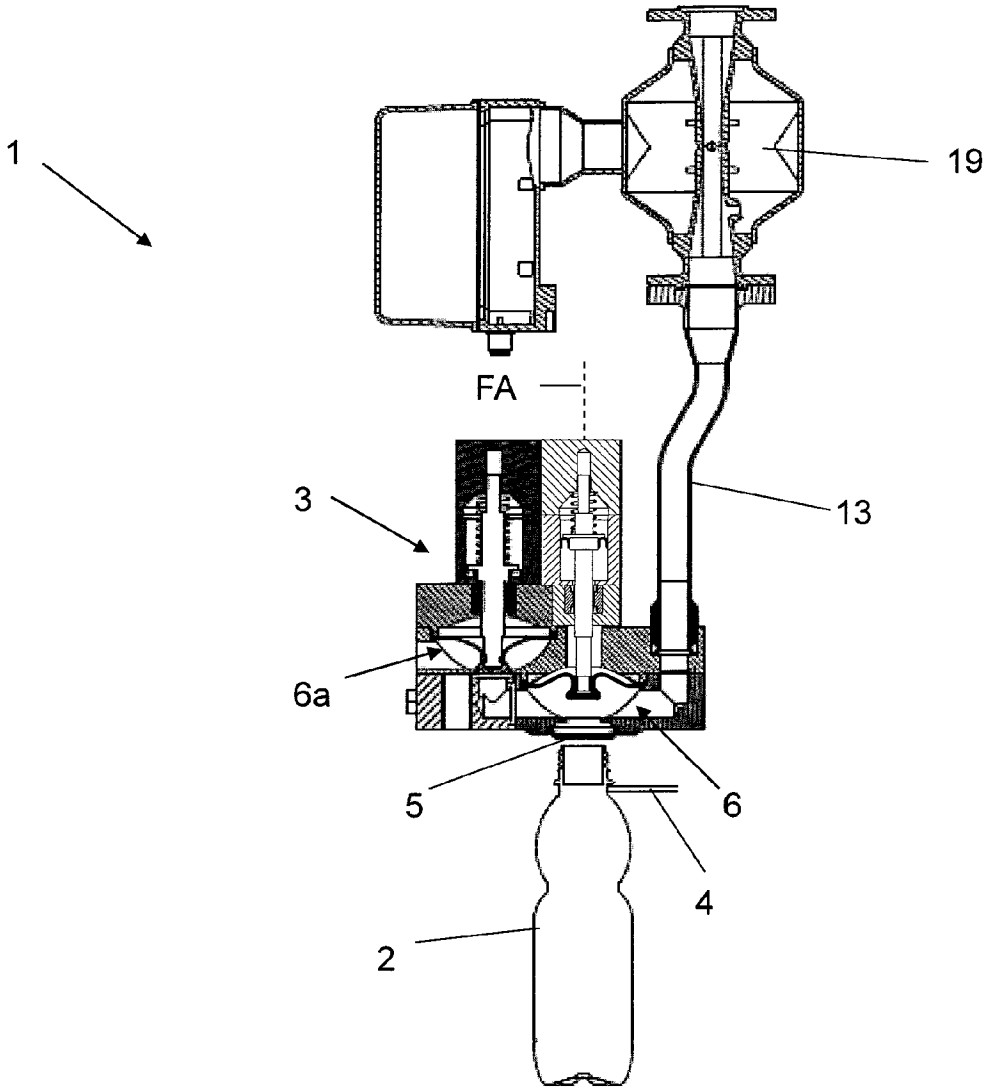
FIG. 1 in a simplified representation, in section, of a filling element of a filling system for filling containers, in the form of bottles, with liquid filling goods, preferably with filling goods having a not inconsiderable solids content.

A filling system 1, shown in FIG. 1, is part of a filling machine, such as a rotating filling machine for volume-controlled or quantity-controlled filling of containers, such as bottles 2, with liquid filling goods. The filling system 1 is suitable for, among other things, filling containers 2 with liquid filling goods that contain solids. Examples of such liquid filling goods include juices with solids such as fruit fibers, and/or fruit pulp etc., in which the solids constitute a relatively high fraction of content relative to the total weight of the goods. These would include liquid filling goods in which the solids constitute between 30% by weight and 60% by weight in relation to the total weight of the filling goods. The presence of such solids interferes with the use of a magnetically inductive flow-meter for determining volume with the necessary precision. In general, using a magnetically inductive flow-meter has been practical only for filling goods that are electrically conductive and that contain no solids or substantially no solids.

The filling system 1 includes a filling element 3 for a known rotating filling machine that has a multiplicity of similar filling elements on the circumference of a rotor that can be rotated around a vertical machine axis. The filling element 3 forms a filling position at which the container 2 to be filled is held, with its container axis vertically oriented, by a container carrier 4. In the illustrated embodiment, seen in FIG. 2, the container 2 is disposed for free jet filling with its container opening 2.1 at a distance below the filling element 3 or at a distance below a discharge opening 5 of the filling element 3.

The invention is not, however, confined to free jet filling. The invention also extends to filling methods and filling valves for container filling under counter-pressure. In this case, the container is positioned tightly on a filling valve, at least during the actual filling. As any structural adaptations that may be necessary are totally self-evident for the person skilled in the art, further explanations about this are not necessary at this point.

Figure 2:
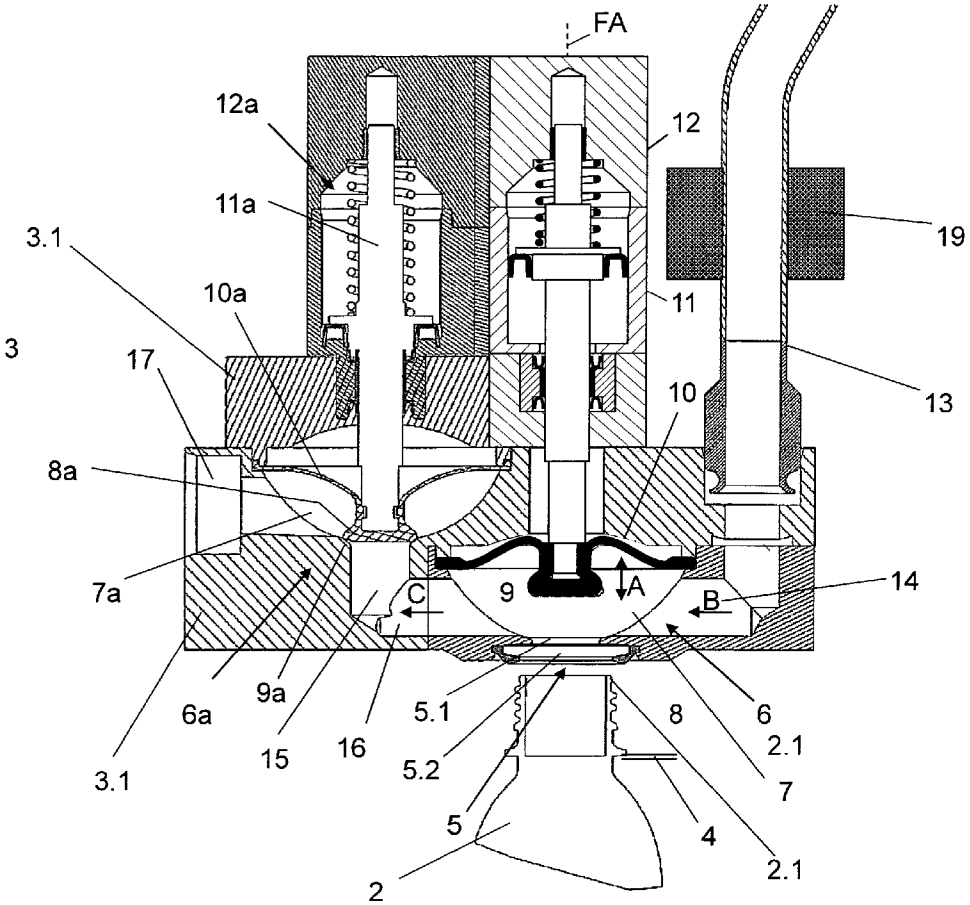
FIG. 2 shows a magnified cross-section of the filling element of FIG. 1.
Figure 3:
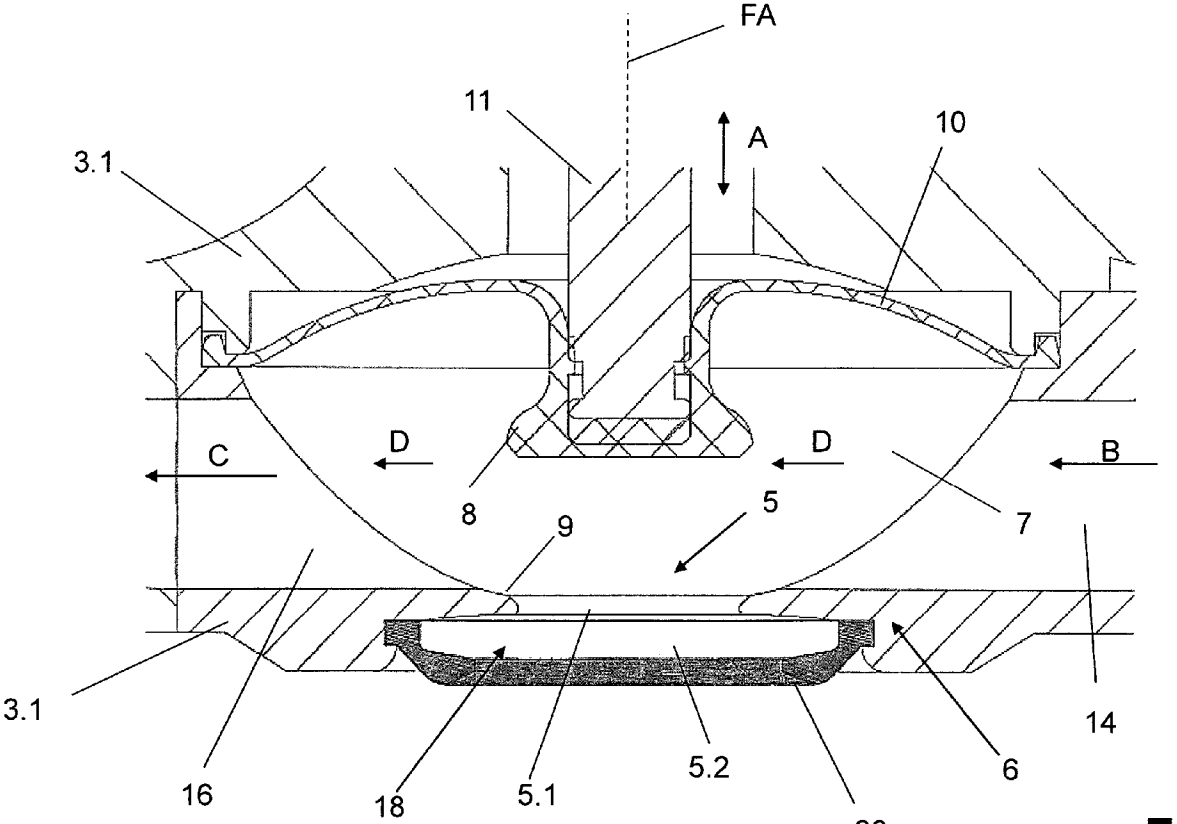
FIG. 3 shows a magnified partial representation of the valve chamber of the filling element of FIGS. 1 and 2, with a drain opening closed with a closure, i.e. a rinsing cap.

A liquid valve 6 for a controlled discharge of the filling goods into the particular container 2 is formed in a multi-part housing 3.1 of the filling element 3. In the illustrated embodiment, the liquid valve 6 includes a valve body 8 disposed in a valve chamber 7. When the liquid valve 6 is closed, the valve body 8 lies against a valve seat 9 formed on an inner surface of the valve chamber 7. In this state, the valve body 8 encloses, in an annular manner, a discharge opening. When the liquid valve 6, illustrated in FIGS. 1-3, is opened, it is spaced from the valve seat 9 toward the discharge opening 5 in a vertical direction, i.e. in the direction of a filling-element axis FA.

In the illustrated embodiment, the valve body 8 is part of a rubber-elastic membrane 10 that tightly seals the valve chamber 7 on the top opposite the discharge opening 5. In detail, the valve body 8 is formed by a central projection of the side that is annular on its tensioned circumference and on the substantially concavely domed membrane 10 on the side facing the valve chamber 7. To actuate the liquid valve 6 or the valve body 8, a valve plunger 11 is provided. At its lower end, the valve plunger 11 is enclosed by a section of the membrane 10 and thus forms the valve body 8. The valve plunger 11 is appropriately connected to this section.

The vertical or substantially vertical axis of the valve plunger 11 is arranged on the same axis as the filling-element axis FA, as the axis of the annular discharge opening 5. The axis of the valve plunger 11 is also coaxial with the axis that is concentrically enclosed by the annular valve seat 9. The valve plunger 11 is part of an actuation installation 12 that moves the valve plunger 11 axially upwards and downwards for the controlled opening and closing of the liquid valve 6 (double arrow A in FIG. 2). One example of an actuation installation 12 is a pneumatic actuation installation.

A pipe 13 connects the filling element 3 to a tank, which is not illustrated. The tank could be a tank of the filling system 1, or of the filling machine. Or, the filling element 13 could be directly connected to the product distributor inlet, which is filled with the liquid filling goods during the filling operation and is provided for all filling elements 3. In the illustrated embodiment, the pipe 13 is provided independently for each filling element 3.

The pipe 13 opens, via a side inlet 14, into the valve chamber 7, so that the direction of flow of the fluid entering the valve chamber 7 through this side inlet 14 is horizontal or substantially horizontal and thus, in the illustrated embodiment, perpendicular to the filling-element axis FA, perpendicular to the axis of the discharge opening 5, perpendicular to the valve plunger 11, or perpendicular to a direction of lift movement of the valve body 8.

Within the housing 3.1 of the filling element 3, a further valve **6*a* is provided. In the illustrated embodiment, the further valve 6*a* is formed in a manner similar to the liquid valve 6. The further valve 6*a* thus has a further valve chamber 7*a*, and a further valve body 8*a* formed by a further membrane 10*a*. Similarly, the further valve 6*a* interacts with an annular valve seat 9*a*. A valve plunger 11*a* and an actuation installation 12*a* cooperate to control opening and closing of the further valve 6*a*. The actuation installation 12*a*** can be a pneumatically actuated actuation installation.

FIG. 2 shows the further valve **6*a* in its closed state, in which the further valve body 8*a* lies against the further valve seat 9***a*, which is formed in the further valve chamber 7*a* in the area of the mouth of a connecting channel 15. The connecting channel 15 is part of an outlet 16 with an outlet cross-section area that opens at the side into the valve chamber 7. As shown in the figure, the outlet 16 is diametrically opposite the inlet 14 in relation to the filling-element axis FA. This arrangement of the outlet 16 in relation to the inlet 14, although advantageous, is not absolutely necessary.

The inlet 14 and the outlet 16 are preferably arranged with their axes on a common height level. The axes are oriented perpendicular or substantially perpendicular to the filling-element axis FA or to the axis of the discharge opening 5. In other embodiments, the axes of the inlet 14 and the outlet 16 enclose an angle that is greater than 90°. In yet other embodiments, the inlet 14 and the outlet 16 are offset from each other in the direction of the filling-element axis FA or in the direction of the axis of the discharge opening 5. This offset is at most equal to twice the cross-section dimension of the inlet 14 and/or of the outlet 16. Preferably however, the offset is equal to the cross-section dimension of the inlet 14 and/or of the outlet 16. In the illustrated embodiment, the inlet 14 and the outlet 16 open at the valve seat 9.

Referring to FIG. 3, due to the side opening of the outlet 16 into the valve chamber 7, there arises, in the area of the outlet 16, with the further valve 6*a* open, a horizontal or substantially horizontal flow of fluid, i.e. a flow of fluid perpendicular or substantially perpendicular to the filling-element axis FA (arrow C) and also a horizontal or substantially horizontal flow of fluid in the valve chamber 7 (arrow D).

In the illustrated embodiment, the discharge opening 5 has an annular partial opening 5.1 that is located at, and has a smaller cross-section than, the opening defined by the valve seat 9. The annular partial opening 5.1 also has a smaller cross-section than the likewise circular partial opening 5.2.

Both partial openings 5.1 and 5.2, which transition into each other, are provided on the same axis as each other and as the filling-element axis FA. An outlet 17 opens laterally into the valve chamber 7*a*. The outlet 17 connects to a fluid channel, for example a return-flow channel.

The filling element 3 also has an outlet channel or path 18 that is connected to the valve seat 9. In the illustrated embodiment the outlet channel or path 18 is substantially formed by the partial openings 5.1 and 5.2. The outlet channel or path 18 has a very short axial length compared to an effective dimension of the discharge opening 5. In the illustrated embodiment, the effective dimension defines a cross-section of the discharge opening 5 formed substantially by the flow cross-section of the partial opening 5.1. The axial length of the outlet channel or path 18 is determined substantially by the wall thickness of the housing 3.1 on its underside in the area of the discharge opening 5. In the illustrated embodiment, the axial length of the outlet channel or path 18, or the distance between the valve seat 9 or the inner surface of the valve chamber 7 and the edge of the opening of the discharge opening 5 on the outside of the housing 3.1 is only approximately 30% to 50% of the major linear dimension of the partial opening 5.1, and preferably just approximately 40% of this dimension.

During the filling of a particular container 2, with the liquid valve 6 open and further valve 6*a* closed, a magnetically inductive flow meter 19 provided on the pipe 13 measures the quantity of the filling goods flowing through the pipe 13 and thus flowing to the container 2. The magnetically inductive flow meter 19 provides a measuring signal for controlling the liquid valve 6. This measuring signal causes the liquid valve 6 to close once the specified quantity of filling goods is reached.

In the illustrated embodiment, the cross-section area of the outlet 16 is approximately 0.7 times to 1.3 times the cross-section area of the inlet 14. Furthermore, cross-sectional areas of the inlet 14, the outlet 16, and the valve chamber 7 are selected so that, even taking into account the side opening of the inlet 14 and the outlet 16 into the valve chamber 7, when the further valve 6*a* open and the discharge opening 5 is closed, a substantially straight flow of fluid (arrows D) oriented perpendicular to the filling-element axis FA arises inside the valve chamber 7 between the inlet 14 and the outlet 7 without areas in which there is no or only an inadequate flow of fluid. This favorable flow arises also because the cross-section dimension of the inlet 14 or the outlet 16 in the axis direction parallel to the filling-element axis FA is, when the liquid valve 6 is closed, equal or substantially equal to a maximum cross-section dimension that the valve chamber 7 has in the direction of the axis parallel to the filling-element axis FA, and to the maximum cross-section dimension of the valve chamber 7 in the direction of the filling-element axis FA with an open liquid valve 6 being only slightly bigger than the cross-section dimension of the inlet 14 and the outlet 16 in the direction of the filling-element axis FA.

On the side opposite the membrane 10, the valve chamber 7 is made concave, for example spherical or substantially spherical, on its inner surface, so that the cross-section of the valve chamber 7 in cross-sectional planes perpendicular to the filling-element axis FA becomes smaller with increasing distance from the membrane 10, and the discharge opening 5 and the annular valve seat 9 are provided in the bottom area with the smallest cross-section.

With the filling element 3, very different modes of operation are possible, for example:

Pre-Heating of the Filling Element 3

With the hot-filling or hot aseptic filling of the filling goods into the containers 2, there is first, preferably, a pre-heating of the filling element 3 with the hot filling goods in a hot cycle. To carry this out, the liquid valve 6 is closed and the further valve 6*a* is opened so that the hot filling goods supplied by the pipe 13 flow through the filling element 3. In particular, the hot filling goods flow through the inlet 14, the valve chamber 7, the outlet 16, the connection 15, and the valve chamber 7*a*. They are then returned by means of the outlet 17.

Filling

To fill the containers 2, the further valve 6*a* is closed and, if containers 2 are arranged on the filling element 3, the liquid valve 6 is opened until the necessary quantity of filling goods has been introduced into the container 2 to be filled. In the illustrated embodiment, the closing of the liquid valve 6 occurs in response to a signal from the magnetically inductive flow meter 19 disposed in the pipe 13.

According to the invention, by particular process-engineering measures, with the magnetically inductive flow-meter 19 a highly accurate fill-quantity-controlled filling of the containers 2 is possible even with filling goods that have a high solids content, for example a solids content of between 30% by weight and 60% by weight. This is possible because the filling goods with a high solids content flow through the magnetically inductive flow-meter 19 at a sufficiently high flow speed or with a sufficiently high volume flow, i.e. with a filling goods volume introduced into the particular container 2. A sufficiently high flow speed has be one that takes less than ten seconds, and preferably less than five seconds, and even less than two seconds to fill 500 ml, one that takes less than ten seconds to fill between 50 ml and 150 ml, or one that takes less than five seconds, or even less than two seconds, to fill between 50 ml and 150 ml.

Due to the high filling speed which is more than 1 meter/second, the magnetically inductive flow-meter 19 will be able to obtain, from the liquid part alone of the filling goods, measured values or signals with a high level of precision. Even taking into account a correction factor which is dependent on the level of the solids content in the filling goods, these signals enable a computer of the filling system 1 to generate a control signal for closing the liquid channel 6 such that the quantity of filling goods introduced into the particular container 2 corresponds precisely, and with a high level of accuracy, to a target fill quantity.

Naturally, instead of the magnetically inductive flow-meter 19, other installations for volume-controlled or fill-quantity-controlled filling can be used, for example weighing installations or weighing cells etc.

Keeping Hot

In hot-filling, after the end of the filling of a container 2 and after the closing of the liquid valve 6, the further valve 6*a* is opened so that hot filling goods can flow through the filling element 3 in the prescribed manner to heat or maintain the hot condition or the target temperature. The hot filling goods are then returned through the pipe connected to the outlet 17.

Rinsing of the Filling Element 3

To rinse the filling element 3, the liquid valve 6 is closed and the further valve 6*a* opened so that the entire liquid valve 3, i.e. in particular inlet 14, valve chamber 7, outlet 16, connecting pipe 15, valve chamber 7*a* and outlet 17, can be flushed through and rinsed with a rinsing or cleaning medium. This medium can again be drained or returned through the pipe connected to outlet 17. Optionally, at the end of the rinsing, the liquid valve 6 can be briefly opened and thereby, and, for example, the further valve 6*a* closed so that the valve seat 9 and the discharge opening 5 can likewise be rinsed.

CIP Cleaning and/or Disinfection

For CIP cleaning and/or CIP disinfection, the discharge opening 5 is first closed by a CIP closure 20, for example in the form of a cap. Then, the liquid valve 6 and the further valve 6*a* are opened so that cleaning and/or disinfection medium supplied by the pipe 13 flows through the entire filling element 3 or the entire flow path formed in the filling element, including inlet 14, valve chamber 7, outlet 16, connecting pipe 15, valve chamber 7*a* and outlet 17. The medium is then returned through the pipe connected to this outlet.

Because the outlet channel 18 has a short axial length compared to the cross-section of the discharge opening 5, and because of the horizontal or substantially horizontal flow direction (arrows B, C and D) inside the valve chamber 7, in the part of the outlet channel 18 closed with the CIP closure 20, i.e. in the space, closed with the CIP closure 20, underneath the valve seat 9, a favorable flow of the liquid cleaning and/or disinfection medium used for the CIP cleaning and CIP disinfection is achieved. This favorable flow causes this area to be reliably cleaned and/or disinfected, without it being necessary to provide, on the CIP closure 20 or on the space closed with the CIP closure 20 underneath the valve seat 9, an additional outlet and/or inlet for the cleaning and/or disinfection medium.

Figure 5:
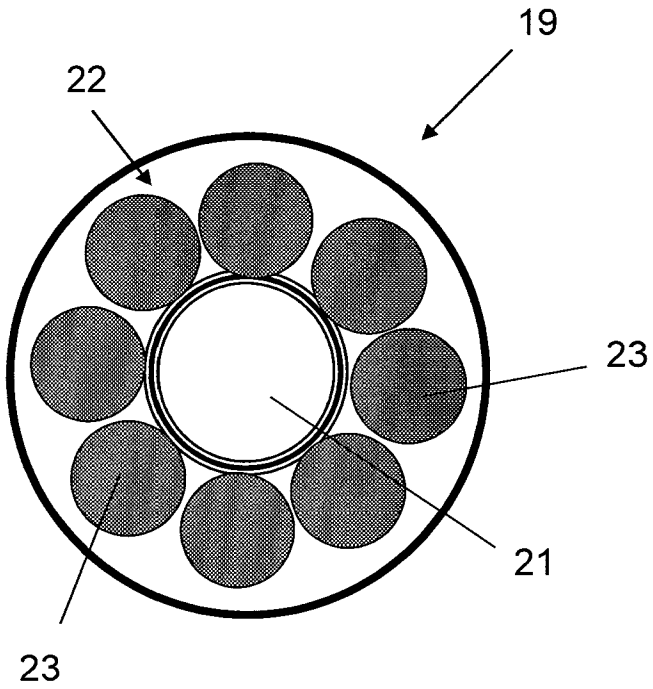
FIGS. 4 and 5 are schematic function or principle representations of side view and a sectional view of a magnetically inductive flow meter for use in the filling system of FIG. 1.
Figure 4:
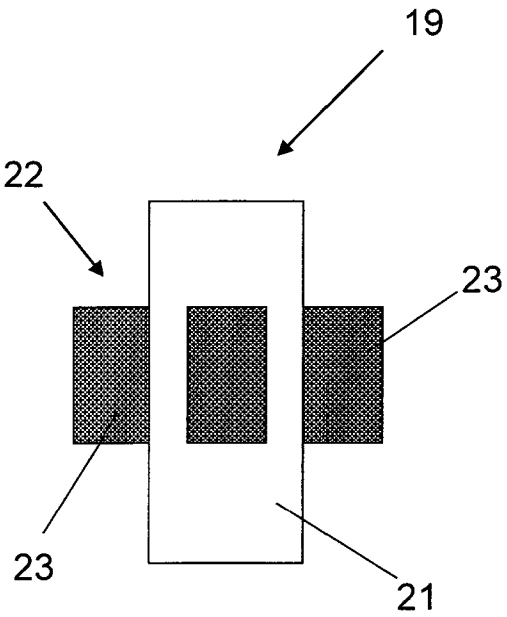

FIGS. 4 and 5 show, in a very schematic representation, a side view and a section through one embodiment of the magnetically inductive flow-meter 19. An electromagnet arrangement 22 is formed in the magnetically inductive flow-meter 19 provided around the channel 21 through which the filling goods flow.

The electromagnet arrangement 22 is formed from a plurality of magnetic coils 23 that each generate a magnetic field necessary for measurements inside the channel 21. The magnetic coils 23 are, for example, part of a corresponding winding. These coils 23 are controlled to be offset in phase. In one embodiment they are phase-offset by 120°. As a result, a rotary magnetic field arises inside channel 21. This rotary magnetic field further increases the relative speed between the filling goods and the magnetic field generating the particular measuring signal. This further contributes to an increase in measuring accuracy and thus to an increase in the filling accuracy, particularly with filling goods that have a high solids content.

In the foregoing embodiments, the valve chamber 7 of the liquid valve has had a horizontal or substantially horizontal through-flow, especially during rinsing and/or during the CIP cleaning and/or CIP disinfection. However, a different arrangement is also possible. In such an arrangement, the corresponding flow direction in the valve chamber of the liquid valve is vertical or substantially vertical.

Figure 6:
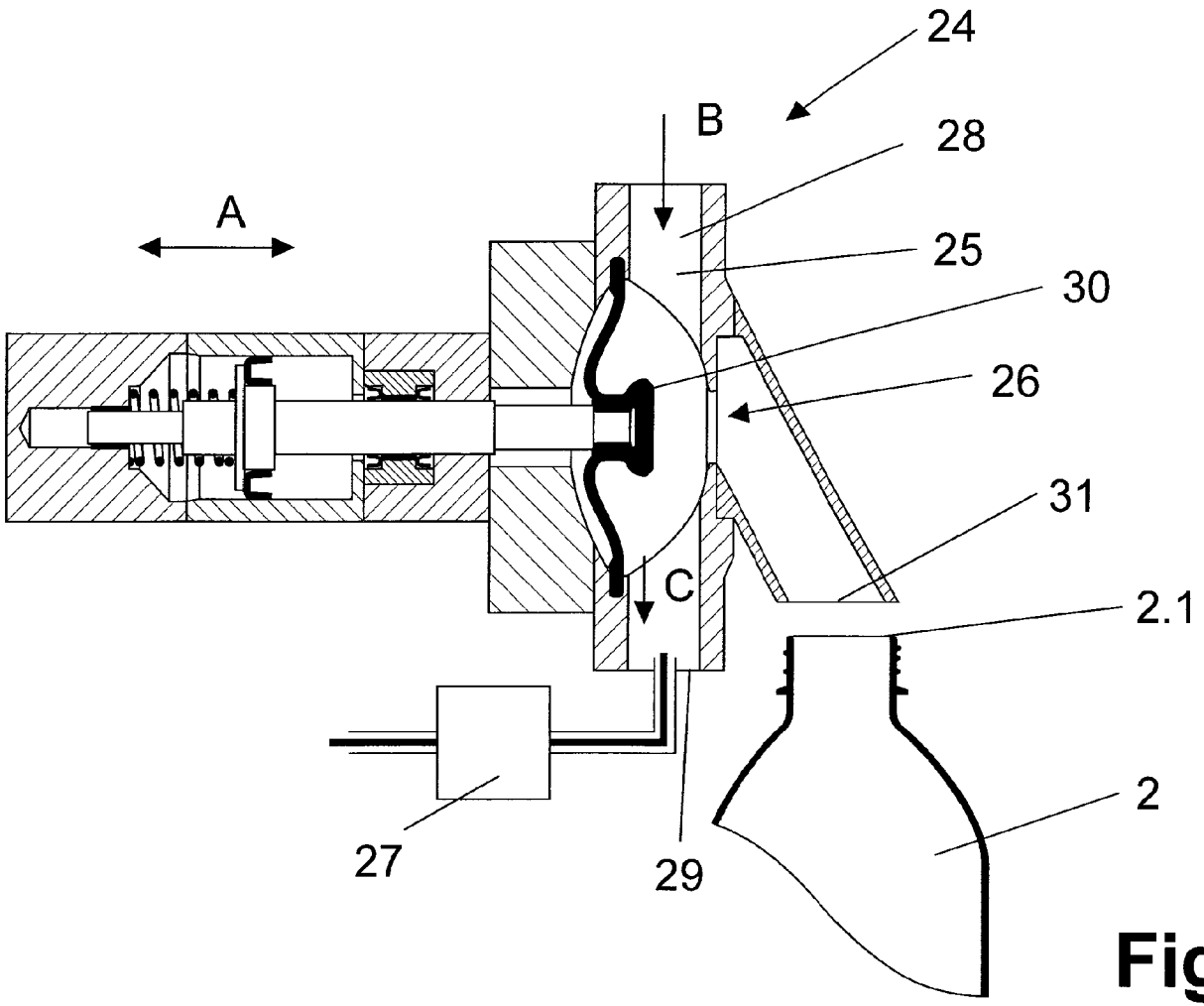
FIG. 6 is a partial representation, in section, of a further embodiment of the filling element according to the invention.

FIG. 6 shows a simplified schematic representation of a filling element 24 having a valve chamber 25 that corresponds, in terms of function, to the valve chamber 7, for the liquid valve 26 corresponding to the liquid valve 6, and with an additional valve 27 corresponding to the further valve 6*a*. The filling element 24 differs from the filling elements 3 substantially only in that the inlet 28, which corresponds to the inlet 14, is located above the outlet 29 corresponding to the outlet 16. The additional valve 27 is connected to the outlet 29. The flow directions at inlet 28 and outlet 29, indicated in turn by the arrows B and C, and thus also the flow direction in the valve chamber 25 when valve 27 is open, are vertical or substantially vertical and t oriented perpendicular to the axis of the movement stroke A of the valve body 30, which corresponds to the valve body 8. A discharge opening 31, which corresponds to the discharge opening 5, is formed by an outlet channel for a larger quantity.

The invention was described above using examples of embodiments. It is clear that numerous modifications and variations are possible without thereby departing from the idea underlying the invention.

REFERENCE DRAWING LIST

1 Filling system
2 Container
2.1 Container opening
3 Filling element
3.1 Filling element housing
4 Container carrier
5 Discharge opening
5.1, 5.2 Partial opening
6 Liquid valve
6*a* Further valve
7, 7*a* Valve chamber
8, 8*a* Valve body
9, 9*a* Valve seat
10, 10*a* Membrane
11, 11*a* Valve plunger
12, 12*a* Actuation installation
13 Pipe
14 Inlet
15 Connecting channel

16, 17 Outlet
18 Outlet channel
19 Magnetically inductive flow-meter
20 CIP closure or CIP cap
21 Channel
22 Electro-magnet arrangement
23 Magnetic coil
24 Filling element
25 Valve chamber
26 Liquid valve
27 Valve
28 Inlet
29 Outlet
30 Valve body
31 Discharge opening
A Lift of valve body 8, 8*a*, 30 when opening and closing the valve
B, C, D Flow direction
FA Filling-element axis

The invention claimed is:

1. A method for filling containers with filling goods, said method comprising selecting said filling goods to have a solids content between 10% by weight and 60% by weight in relation to a total weight of said filling goods, causing a first flow of filling goods, causing a second flow of filling goods, and causing a third flow of filling goods, wherein causing said first flow comprises causing said filling goods to flow into a filling element that has a discharge opening and an outlet, said discharge opening being disposed along a filling-element axis of said filling element, said filling goods being directed to flow along a flow path through said outlet for return-flow of said filling goods and to do so along a flow direction that is perpendicular to said filling-element axis, whereby, as a result, said filling goods fail to enter any container, wherein causing said second flow comprises causing flow of filling goods through a magnetically inductive flow meter and through said discharge opening, whereby said filling goods enter a container disposed to receive said filling goods through said discharge opening, said flow being high enough to pass between 50 ml and 150 ml of said filling goods in less than ten seconds, and using said magnetically inductive flow meter for controlling a quantity of said filling goods that enters said container, and wherein causing said third flow comprises, after a desired quantity of filling goods has entered said container, causing flow of filling goods in said flow direction toward said outlet.

2. The method of claim 1, further comprising generating a rotating magnetic field, causing said filling goods to flow through said rotating magnetic field, and generating a signal based on flow of said filling goods through said rotating magnetic field.

3. The method of claim 1, further comprising causing a liquid valve to discharge a controlled quantity of said filling goods into said container.

4. The method of claim 1, further comprising heating said filling element, wherein heating said filling element comprises, when causing said first flow, selecting said filling goods to be heated filling goods, and causing said filling goods to flow through a valve chamber of said filling element along a flow path having a liquid valve and a further valve, wherein said further valve is open and said liquid valve is closed.

5. The method of claim 1, further comprising, prior to filling said containers with filling goods, executing an operation, wherein executing said operation comprises causing a medium to flow through a valve chamber having a liquid valve, a further valve, and a discharge opening, wherein, during said operation, said medium flows through a flow path in which said further valve is open and said discharge opening is closed with one of a closing cap and a closure, wherein said operation is selected from the group consisting of a rinsing operation, a cleaning operation, and a disinfecting operation, and wherein said medium is selected from the group consisting of a rinsing medium, a cleaning medium, and a disinfection medium.

6. The method of claim 1, further comprising, prior to filling said containers with filling goods, executing an operation, wherein executing said operation comprises causing a medium to flow through a valve chamber having a liquid valve, a further valve, and a discharge opening, wherein, during said operation, said medium flows through a flow path in which said further valve is open and said liquid valve is closed with one of a closing cap, and a closure, wherein said operation is selected from the group consisting of a rinsing operation, a cleaning operation, and a disinfecting operation, and wherein said medium is selected from the group consisting of a rinsing medium, a cleaning medium, and a disinfection medium.

7. An apparatus for filling containers with filling goods, said apparatus comprising a filling element for a filling system, said filling element being configured to receive filling goods that comprise a liquid and a solids content, said filling goods having a solids content between 10% by weight and 60% by weight in relation to total weight of said filling goods, said filling element comprising a filling-element housing, a valve chamber, a liquid valve, a valve seat, a valve body, an actuation installation, an inlet, an outlet, a discharge opening, a further valve, and a magnetically inductive flow meter disposed along a path of said filling goods, wherein said filling element has a filling-element axis that passes through said discharge opening, wherein said discharge opening is disposed to pass filling goods into a container along said filling-element axis, wherein said magnetically inductive flow meter comprises an electromagnet arrangement, wherein said electromagnet arrangement generates a rotating magnetic field within a measuring channel through which said filling goods flow, wherein said valve chamber is formed in said filling element housing, wherein said liquid valve and said valve body are disposed in said valve chamber, wherein said liquid valve and said valve body interact with said valve seat, wherein said actuation installation opens and closes said liquid valve with a movement stroke, wherein said liquid valve transitions between a position releasing said valve seat and a position lying against said valve seat, wherein said inlet opens into said valve chamber, wherein said outlet opens into said valve chamber with opening of said further valve, wherein said inlet and said outlet open into said valve chamber such that, when said further valve opens, a flow path arises between said inlet and said outlet along a direction that is perpendicular to said filling-element axis, and wherein said flow path is selected from the group consisting of a straight-line flow path and a flow path that avoids areas without flow.

8. The apparatus of claim 7, wherein said inlet opens into said valve chamber.

9. The apparatus of claim 7, wherein a cross-sectional area of said outlet is between 0.7 and 1.3 times that of said inlet.

10. The apparatus of claim 7, wherein an axial length of an outlet channel at said outlet is substantially smaller than a cross-section dimension of a discharge opening.

11. The apparatus of claim 7, wherein said valve body comprises a section of a membrane, wherein said membrane comprises a rubber-elastic material.

12. The apparatus of claim 7, wherein said inlet and said outlet are arranged for substantially one-dimensional flow inside said valve chamber.

13. The apparatus of claim 7, wherein said inlet and said outlet are coaxial.

14. The apparatus of claim 7, wherein said inlet has an axis, wherein said outlet has an axis, wherein said axis of said inlet and said axis of said outlet enclose an angle, and wherein said angle is in excess of a right angle.

15. The apparatus of claim 7, wherein an axis of said inlet and an axis of said outlet are arranged on a common height level.

16. The apparatus of claim 7, wherein an axis of said inlet and an axis of said outlet are offset in height from each other.

17. The apparatus of claim 7, wherein said further valve and said liquid valve have the same design.

18. The apparatus of claim 7, wherein said outlet opens into said valve chamber.

19. The apparatus of claim 7, wherein an outlet on said valve seat opens into said valve chamber.

20. The apparatus of claim 7, wherein an outlet a distance from said valve seat into said chamber opens into said valve chamber, said distance being smaller than said movement stroke of said valve body.

21. The apparatus of claim 7, wherein said flow path is a straight-line flow path.

* * * * *